United States Patent [19]

Rottenkolber

[11] 4,303,253

[45] Dec. 1, 1981

[54] ROLLER SKATE CONSTRUCTION HAVING PIVOTAL HEEL

[75] Inventor: John Rottenkolber, Mohegan Lake, N.Y.

[73] Assignee: Ronald Kestenbaum, Brooklyn, N.Y.

[21] Appl. No.: 190,968

[22] Filed: Sep. 26, 1980

[51] Int. Cl.[3] ..... A63C 17/04

[52] U.S. Cl. ..... 280/11.27; 280/87.04 R

[58] Field of Search ..... 280/11.22, 11.19, 11.27, 280/11.26, 11.1 BT, 11.1 R, 87.04 R

[56] References Cited

U.S. PATENT DOCUMENTS

| | | | |
|---|---|---|---|
| 116,690 | 7/1871 | Curtis | 280/11.19 |
| 2,150,814 | 3/1939 | Barbato | 280/11.27 |
| 3,827,706 | 8/1974 | Milliman | 280/11.1 BT |

FOREIGN PATENT DOCUMENTS

| | | | |
|---|---|---|---|
| 1049029 | 8/1953 | France | 280/11.19 |
| 104584 | 7/1924 | Switzerland | 280/11.19 |

*Primary Examiner*—Joseph F. Peters, Jr.
*Assistant Examiner*—Donald W. Underwood
*Attorney, Agent, or Firm*—Charles E. Temko

[57] ABSTRACT

A roller type skate construction having a rear wheel assembly comprising a fixed platform having a lower horizontal surface from which depend a plurality of casters, each having a horizontal axis of rotation and at least some having a vertical axis of rotation in offset relation, whereby a skater may execute a turn while standing in place by pivoting about an axis through the ball of the foot, the heel portion moving laterally to describe an arc about said axis.

2 Claims, 5 Drawing Figures

ROLLER SKATE CONSTRUCTION HAVING PIVOTAL HEEL

BACKGROUND OF THE INVENTION

This invention relates generally to the field of roller skates, and more particularly to an improved form of skate particularly adapted for figure skating, or other forms of skating involving a high degree of maneuvering. Devices of this general type are known in the art, and the invention lies in specific constructional details permitting improved flexibility with regard to skater performance.

In recent years there has been a serious attempt to upgrade the quality of roller skates, both from the standpoint of noise and design features. With the provision of synthetic resinous wheels, the skate has become creditably smooth and quiet during skating, as well as longer wearing. However, the degree of maneuverability, as compared with ice skates, has been relatively poor owing to the fact that only a limited degree of lean is possible due to the fact that the skate is supported by four wheels. During normal skating, all four wheels are in contact with a supporting surface, and turning is usually accomplished by a stepping motion in which the skate is aimed in the desired direction. Where the stability of movement by contact of both skates is required, such turning action is not possible.

Various solutions to the problem have been proposed. One structure includes the provision of ball-type casters which permit relative movement of the skate in any desired direction. Unfortunately, such provision lacks directional stability when the skating is in a straight line. Others have includes a cluster of casters adapted to rotate about a single vertical axis with equally undesirable results.

SUMMARY OF THE INVENTION

Briefly stated, the invention contemplates the provision of an improved skate construction of the class described in which the abovementioned disadvantages have been substantially eliminated. In one preferred embodiment an otherwise conventional type roller skate is provided with a forward set of wheels the rotational axis of which is fixed in a substantially horizontal plane and perpendicular to the line of normal forward movement. The rear of the skate is supported upon a platform, a lower horizontal surface of which supports a plurality of casters each including a vertical axis of rotation passing through the platform, and an offset horizontal axis of rotation whch supports a wheel. During linear movement, the front wheels guide the skate in a substantially straight line. Upon the execution of rapid turn with both skates in contact with a supporting surface, it is possible to pivot about the ball of the foot, with the heel moving laterally from the principal axis of the skate. In such event, the casters individually pivot about the respective vertical axes thereof, prior to rotation of the caster wheels about the respective horizontal axes thereof.

In another preferred embodiment, castings of the abovedescribed type are provided at the heel of the skate, and in addition a pair of wheels are provided, the axis of rotation of which is fixed perpendicular to the principal axis of the skate. When executing pivotted motion, the last mentioned wheels are slid laterally with little or no rotation to provide a measure of frictional resistance to the pivotting action, and give the skater better control. When the skate is moving along its own principal axis, the same wheels provide additional stability.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 2:
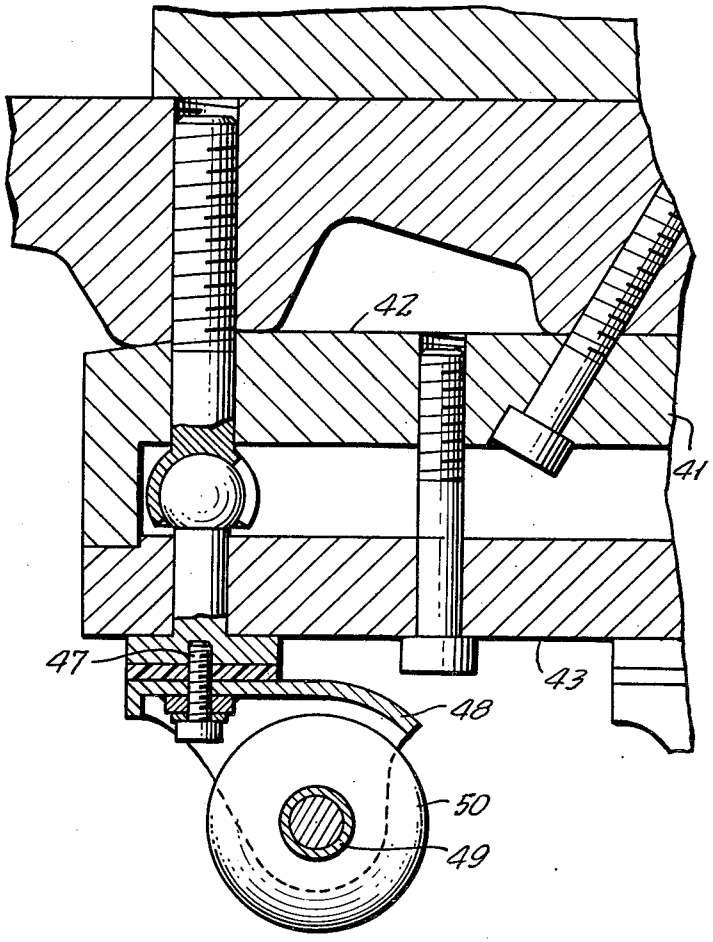
FIG. 2 is a fragmentary vertical sectional view showing a rotary heel element thereof.
Figure 1:
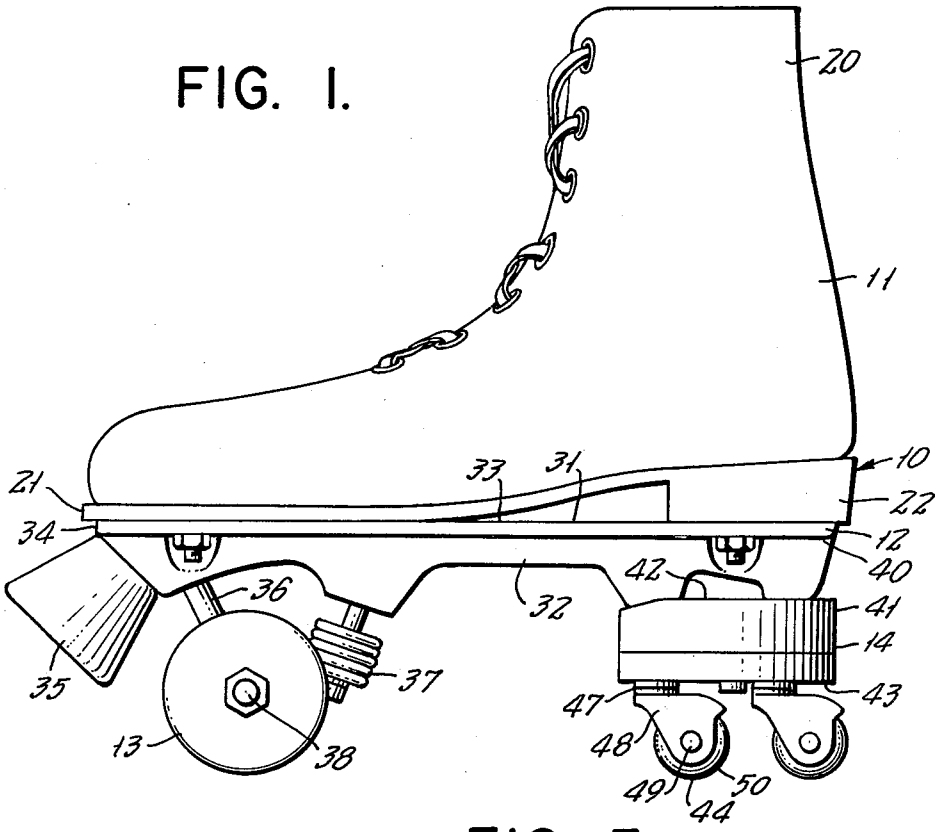
FIG. 1 is a side elevational view of an embodiment of the invention.
Figure 3:
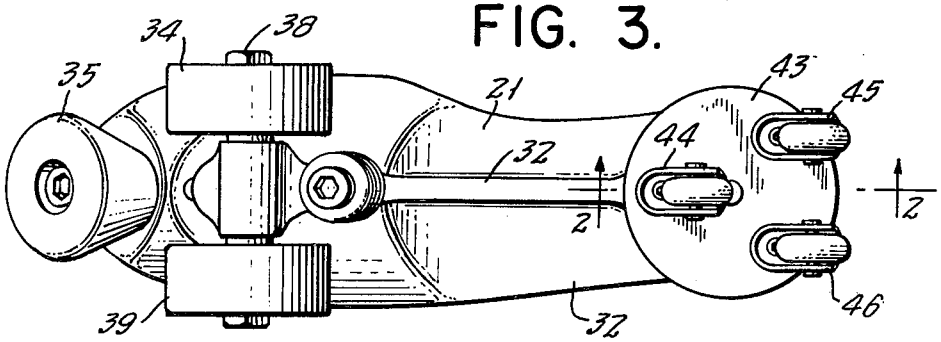
FIG. 3 is a bottom plan view thereof.
Figure 4:
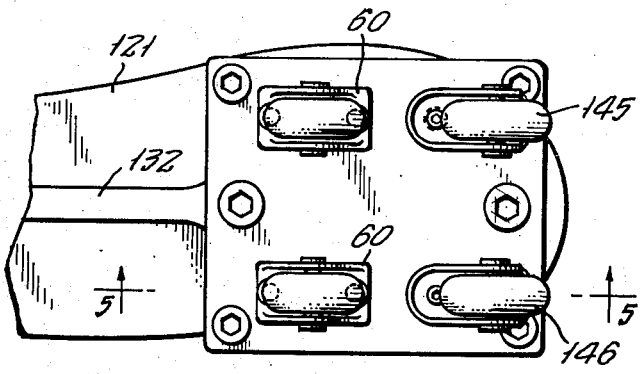
FIG. 4 is an enlarged side elevational view corresponding to that seen in FIG. 1, but showing a second embodiment of the invention.
Figure 5:
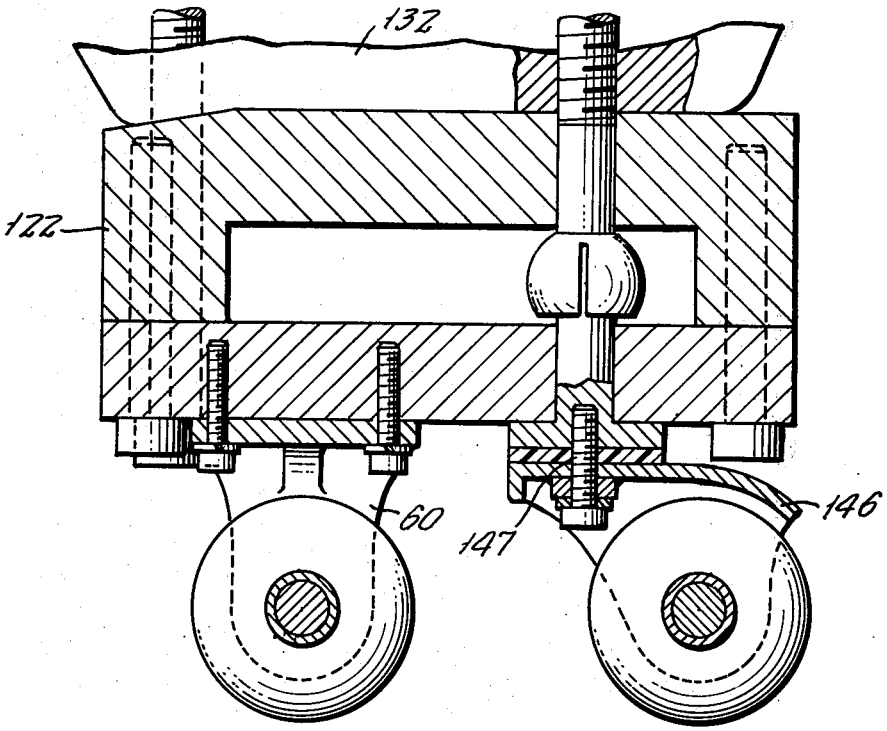
FIG. 5 is a bottom plan view of the second embodiment.

In accordance with the first embodiment of the invention, the device, generally indicated by reference character 10 comprises broadly: a shoe element 11, a rigid platform element 12, a front wheel assembly 13 and a rear wheel assembly 14.

The shoe element 11 is entirely conventional in construction, including a flexible upper 20, a sole member 21 and a heel member 22 which are secured in conventional manner to the assemblies 13 and 14.

The platform element 12 is preferably in the form of a metallic casting, and includes an upper horizontal wall 31 and a centrally disposed longitudinally extendinb web 32. The upper surface 33 of the wall 31 is interconnected by means not shown, including bolts and plates to the lower surface of the sole and heel members 21 and 22. A forward end 34 of the element 12 is provided with a rubber bumper 35 of known type to assist in rapid stops. Front suspension members 36 and 37 support a transversely extending axle 38 in turn supporting wheels 39 in known fashion.

The rearward end 40 of the platform supports a generally circular body 41, an upper surface 42 thereof underlying the wall 31. A lower surface 43 mounts first, second and third casters 44, 45 and 46, respectively, each including a vertically disposed shaft or spindle 47, a caster housing 48 mounting a pintle 49 upon which a caster wheel 50 is supported.

The three casters are mounted adjacent the periphery of the body 41, at one hundred twenty (120) degree mutual displacements. When the skate is moving in a straight line, the casters align themselves behind the front wheels 39, and skating is performed in a normal manner. When it is desired to execute a quick turn by pivoting on the balls of the foot of the user, the casters 44–46, inclusive, will pivot about their vertical axes through ninety (90) degrees and allow the rear end of the skate to moved laterally and arc about the ball of the foot. As soon as normal skating is resumed, the casters again realign themselves behind the front wheels.

Turning now the second embodiment of the invention, parts corresponding to those of the first embodiment have been designated by similar reference characters with the additional prefix "1".

The second embodiment differs from the first embodiment in the elimination of one of the pivotally mounted rear walls, and the addition of a pair of wheels 60 in lieu thereof which have a fixed axis of rotation. When a turn is executed, the wheels 60 which are formed of a relatively smooth and rigid synthetic resinous material such as polyurethane, slide over the supporting horizontal surface, and provide a small degree of tortinal resistance to the maneuver which assists the skater in maintaining control. When running forward, the wheels 60 contribute to linear motion stability.

I wish it to be understood that I do not consider the invention limited to the precise details of structure shown and set forth in this specification, for obvious modifications will occur to those skilled in the art to which the invention pertains.

I claim:

1. In a roller skate including a platform element and a wheeled means at forward and rearward ends thereof and having means for engaging the foot of the user to an upper surface of said platform element, improved means for permitting lateral movement of a rear portion of said platform relative to a principal axis of said platform comprising: a rear wheel element including a body secured to said platform element at the rearward end thereof, at least one caster mounted upon and extending downwardly from a lower surface of said body, said caster including a vertically extending shaft pivotally associated with said body, a caster housing carried by said shaft, and a wheel arranged for rotation about a horizontal axis offset with respect to the axis of said vertically extending shaft; and at least one wheel on said rear wheel element, the axis of which is fixed perpendicular to the principal axis of said skate, and positioned such that the lower periphery thereof continuously lies in a common horizontal plane with the lower periphery of said wheel of said caster and said forward wheeled means whereby when said user executes a pivotal movement about said forward end of said skate, said last mentioned wheel is slid laterally with relative little rotation to provide a measure of frictional resistance to the pivoting motion, thereby enabling said user to better control said pivotal movement.

2. The improvement in accordance with claim 1, further comprising a plurality of wheels on said rear element having coplanar axes of rotation fixed perpendicular to said principal axis of said skate, and a plurality of said caster wheels positioned immediately rearwardly of said last mentioned plurality of wheels.

* * * * *